United States Patent [19]

Gosch

[11] Patent Number: 4,580,642

[45] Date of Patent: Apr. 8, 1986

[54] ZERO DEVIATION DRILL BITS

[76] Inventor: Mark A. Gosch, 2103 Wydewood, Midland, Tex. 79707

[21] Appl. No.: 624,402

[22] Filed: Jun. 25, 1984

[51] Int. Cl.[4] ..... E21B 7/00; E21B 10/08

[52] U.S. Cl. ..... 175/57; 175/325; 175/343; 175/353

[58] Field of Search ..... 175/343, 350, 353, 325, 175/348, 57

[56] References Cited

U.S. PATENT DOCUMENTS

| | | | |
|---|---|---|---|
| 1,856,437 | 5/1932 | Seifert | 175/348 |
| 2,154,032 | 4/1939 | Catland | 175/348 |
| 2,336,333 | 12/1943 | Zublin | 175/320 |
| 2,841,366 | 7/1958 | Dunn | 175/325 |
| 3,429,390 | 2/1969 | Bennett | 175/343 |
| 3,907,048 | 9/1975 | Gray | 175/348 |
| 3,923,109 | 12/1975 | Williams | 175/343 |
| 4,433,738 | 2/1984 | Moreland | 175/349 |

*Primary Examiner*—Stephen J. Novosad
*Assistant Examiner*—Michael Goodwin
*Attorney, Agent, or Firm*—Marcus L. Bates

[57] ABSTRACT

Method and apparatus for drilling a straight borehole in all types of geological formations by the provision of a drilling tool that maintains a constant hole angle respective to the vertical as the borehole is formed. The apparatus includes a bit to which there is rotatably secured a plurality of cones. The cones are mounted to a cutterhead, with the cutterhead being attached to the lower marginal end of a shank. The cutterhead is placed at an incline respective to the shank whereby a plane passing through the cones of the bit lies obliquely respective to the axial centerline of the shank. When the bit weight is applied, the oblique angle between the cones and the shank causes the drill string weight to be transferred unevenly to the cones, whereupon a significant radial force is effected on each of the individual cones. This resultant radial force is always directed in the same direction respective to an outside edge of the rotating bit, whereupon a specific part of the bit is forced towards the outside of the hole as the bit rotates through one revolution. A plurality of radially spaced rollers located immediately above the cutterhead stabilize the shank of the drilling tool.

14 Claims, 8 Drawing Figures

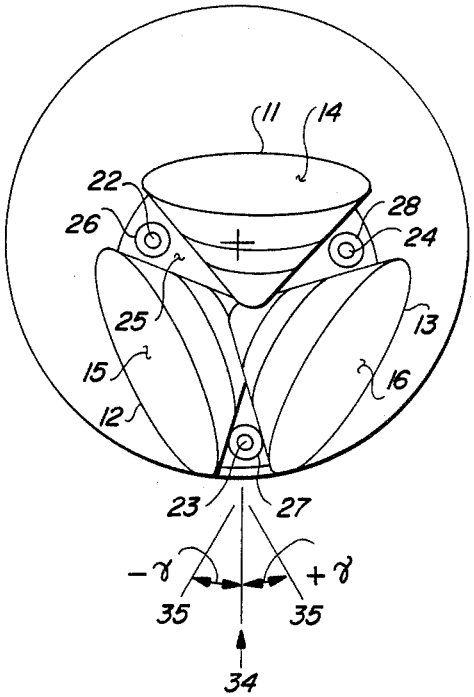
FIG. 2
FIG. 3
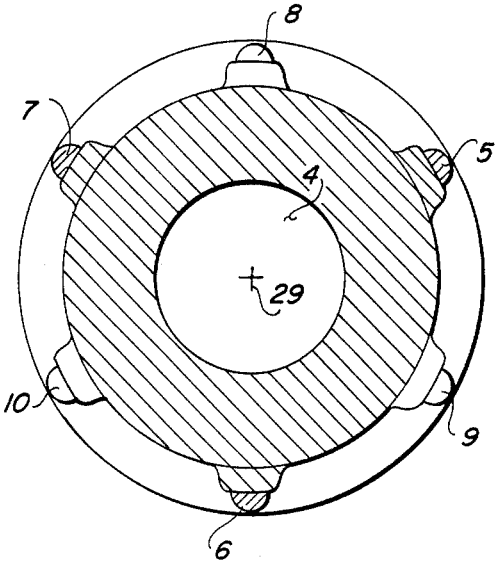
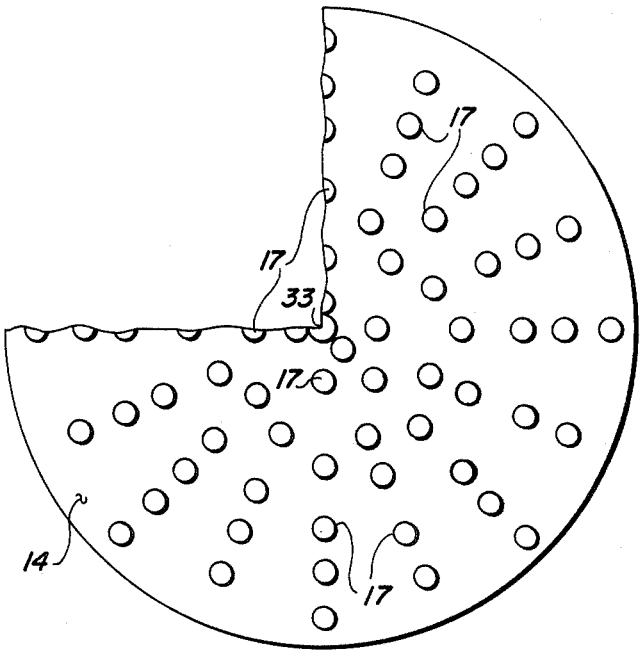
FIG. 4

ZERO DEVIATION DRILL BITS

BACKGROUND OF THE INVENTION

In drilling boreholes, stabilizers are often placed at a location to add stiffness to the drill string so that the string will not bend or move to the sidewall of the hole in response to an opposing force offered by the formation being penetrated. Alternatively, the drill string is sometimes made very limber in order to take advantage of the centrifugal forces associated with the bit rotation. In any event, when a borehole commences to deviate from the vertical, the weight on the bit as well as the rotary speed can be adjusted to oppose and overcome this deviating force. However, the hole often is deviated several degrees before these remedial actions can be employed. Furthermore, these drilling techniques require that the bit weight, rotary speed, and pump pressure be adjusted to a value which increases the cost of making the borehole.

Three coned rock bits are known to those skilled in the art. It is also known in the art to arrange the cutters of a rotary bit whereby a plane passing through the cutters are arranged obliquely respective to the longitudinal axial centerline of the drill string as evidenced by the patents to Seifert U.S. Pat. No. 1,856,437; Catland U.S. Pat. No. 2,154,032; Zublin U.S. Pat. No. 2,336,335; Rossman U.S. Pat. No. 2,362,860; Willis U.S. Pat. No. 4,168,755; Zublin U.S. Pat. No. 2,336,337; and Beeman U.S. Pat. No. 4,372,403.

The present invention differs from the above cited prior art in that the cutterhead, while having only a simple rotational motion about the longitudinal axial centerline thereof and is motionless, is formed with respect to the pin and shank portion of the bit, such that the centerline containing the centroid of any area of the cutterhead arrived at by a vertical cross-sectioning of the bit, will be the obliqued centerline and not the longitudinal axial centerline. Furthermore, the cones, while being arranged obliquely, are located about the cutterhead such that the centroid of the plurality of cutters is located on the oblique centerline and not the longitudinal axial centerline. Also, the placement of the teeth on the cone, whether inserts or milled teeth, is such that if a circle with its center located on the rotational axis of the cone were inscribed on the outer surface of the cone at any specified distance from the plane of the base of the cone, will be such that the described circle intersects a plurality of the teeth.

SUMMARY OF THE INVENTION

This invention relates to method and apparatus for drilling a straight hole. The method of the invention is carried out by the provision of a drilling tool which includes a drill bit having a plurality of cutters, preferably in the form of cones. The cones are rotatably attached to a cutterhead and the cones lie in a common plane. The cutterhead is attached to a shank, and has no motion relative to the shank. The shank is axially aligned with the drill string. The plane through the cones lies obliquely to the rotational axis of the drill string. The centroid of the cones lies within this plane but does not lie on the rotational axis of the drill string.

In one embodiment of the invention, the shank of the bit includes a stabilizer in the form of rollers circumferentially disposed equal distances about the longitudinal axis thereof.

Accordingly, a primary object of the present invention is the provision of method and apparatus by which a borehole is caused to be formed along a straight line during the drilling process.

Another object of the present invention is the provision of a drilling tool having a high rate of penetration while drilling a straight hole.

A still further object of the present invention is the provision of a drilling tool having an improved fluid ejecting pattern that results in a superior bottom hole cutting removal and bit lubrication and bit cooling.

Another and still further object of the present invention is the provision of a drilling tool having an improved drilling head in combination with a stabilizer which drills a straight hole at a high rate of penetration.

The above objects of the invention are achieved by the provision of a drill tool having three a coned cutterhead, wherein one cone is located at a lower elevation respective to the other cones, and further including a stabilizer located above the cones, whereby a straight hole is formed through a crooked hole type formation.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the present disclosure.

BRIEF DESCRIPTION OF THE DRAWINGS

FIG. 2 is an enlarged bottom view of the drill tool seen in FIG. 1, looking in the direction indicated by the arrows at numeral 2—2;

FIG. 3 is an enlarged, cross-sectional view taken along line 3—3 of FIG. 1;

FIG. 4 is an enlarged, part diagrammatical, part schematical, hypothetical illustration of the construction of one of the cones of the drill bits disclosed in FIG. 1;

DETAILED DESCRIPTION OF THE PREFERRED EMBODIMENTS

Figure 1:
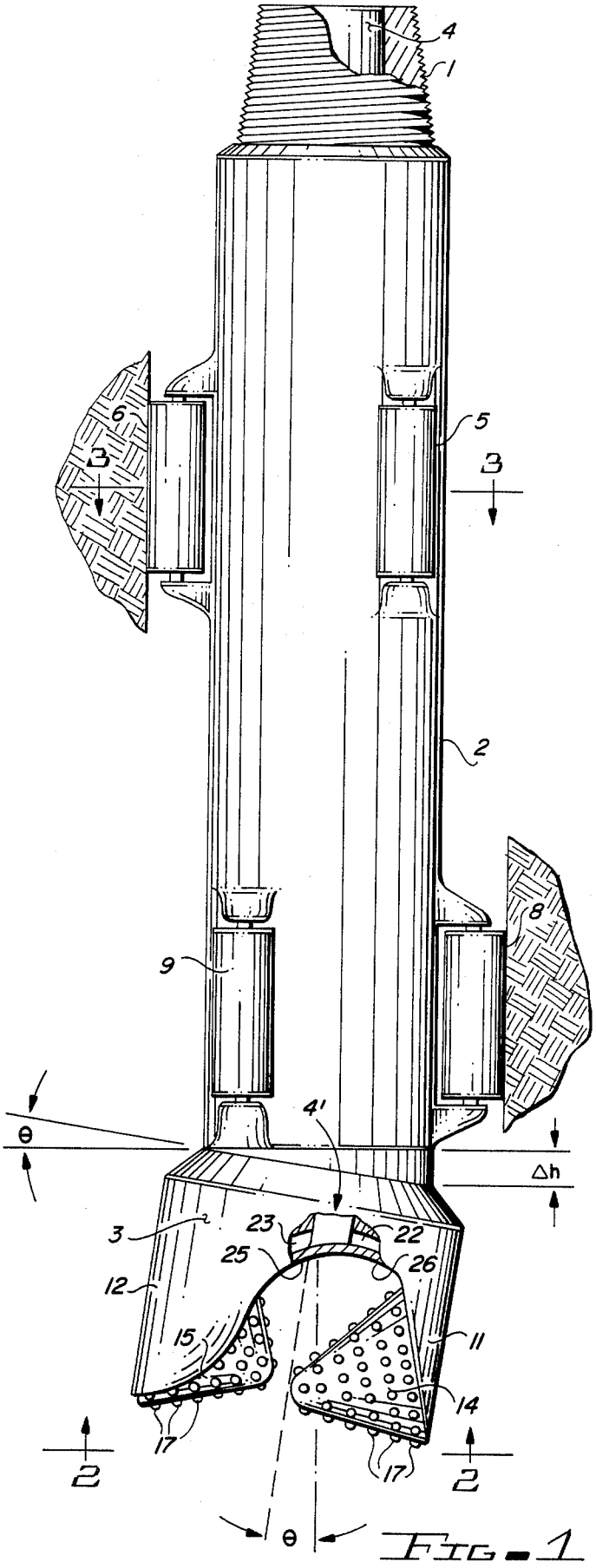
FIG. 1 is a side elevational view of a drill tool made in accordance with the present invention, with some parts being broken away therefrom and some of the remaining parts being shown in cross-section.

FIG. 1 discloses a drill tool made in accordance with the present invention. The drill tool includes a threaded pin 1 located at the upper terminal end thereof for use in connecting the tool to the lower end of a drill string (not shown). The pin 1 is made integrally with a main body 2, hereinafter called a shank. The shank preferably is cylindrical in cross-section, with there being an internal fluid passageway 4 extending through the main body along the longitudinal central axis thereof.

As seen in FIGS. 1 and 3, a plurality of cylindrical shaped stabilizing elements in the form of rollers 5, 6, 7, 8, 9 and 10 are affixed externally to the shank in radially spaced relationship respective to one another, with there being a first group of rollers 5, 6, and 7 spaced above a second group of rollers 8, 9 and 10.

Figure 5:
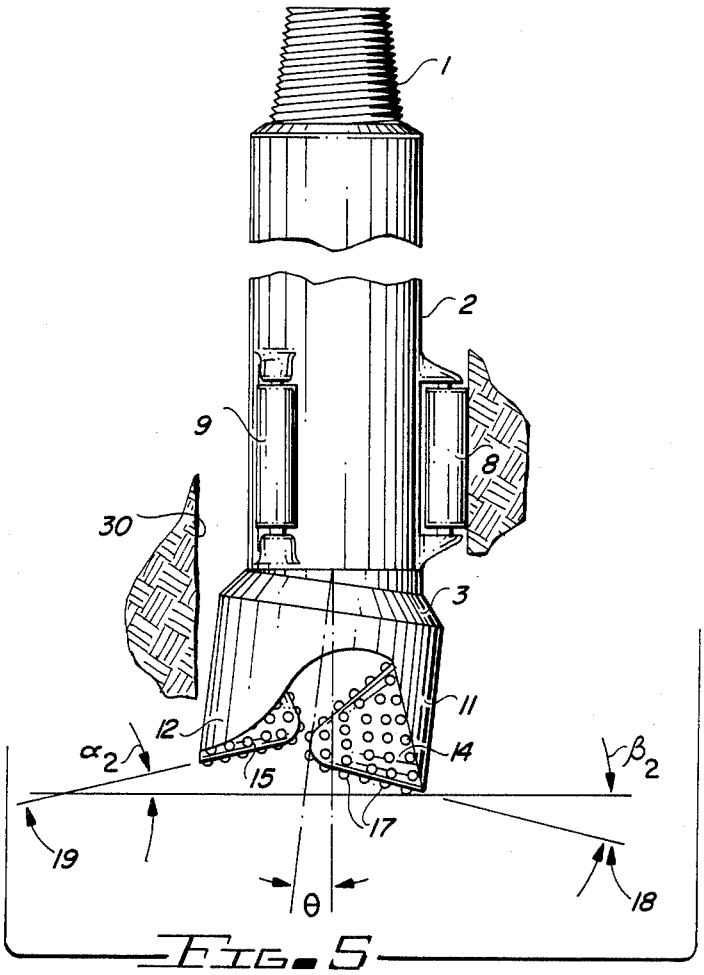
FIG. 5 is a side, elevational view of another embodiment of a drill bit made in accordance with the present invention.

It will be noted in FIGS. 1, 2, and 5 that a cutterhead 3 forms an integral part of the tool and includes three downwardly projecting legs 11, 12 and 13. The legs are rigidly attached to and form part of the cutterhead 3. The free end of each of the legs rotatably receives a cutting element or cone 14, 15 and 16. Each cone 14, 15, 16 includes a plurality of cutting teeth 17 formed thereon, as will be more fully discussed later on in the disclosure.

As particularly seen in FIG. 5, together with other figures of the drawings, the lowermost surface of the lowermost cone 14 lies along a line 18 and forms an acute angle $\beta_2$ respective to a plane drawn perpendicularly respective to the longitudinal axial centerline of the shank, or to the central axis of the formed borehole. The angle $\beta_2$ is greater than the angle $\alpha_2$. The angle $\alpha_2$ is the angle formed between the perpendicular plane and a line 19 drawn along the lower surface of one of the opposed cones 15 or 16.

The teeth 17 of cone 15 and 16 remove cuttings from the formation which forms the bottom of the borehole and maintains the gauge of the hole. When the bit weight and torque are increased during the drilling process, a residual, radial force $R_T$ or 21 of FIG. 2, rotates with the bit. During the drilling process, the residual radial force $R_T$ is vectorially added to an opposing force offered by the formation, $F_F$ or 34 of FIG. 2. The vectorial addition of 21 and 34 (or $R_T$ and $F_F$) as the bit rotates will result in a total deviating force $R_D$ seen at 35 in FIG. 2. During each revolution of the bit, the direction of the deviating force $R_D$, may lead the rotation of the bit by an angle of $+\gamma$ or lag the rotation of the bit by an angle of $-\gamma$.

In FIGS. 1, 2, and 3, the drilling fluid passageway 4 is shown to extend down through the shank into proximity of the cutterhead, where the flow diverges into three passageways 22, 23, and 24 for providing fluid flow for the face of the bit. Each fluid passageway 22, 23, 24 extends through the face 25 formed on the lower surface of the cutterhead and flows through a standard jet nozzle 26, 27, and 28 located in the illustrated manner of FIG. 2. There preferably is one nozzle located between adjacent cones.

Figure 6:
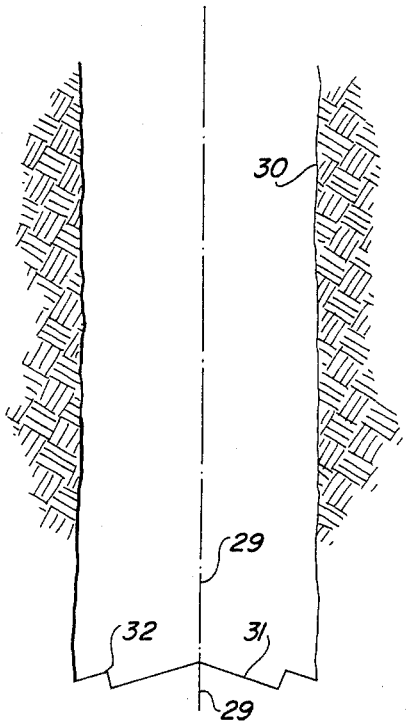
FIG. 6 is a part diagrammatical, part schematical, part cross-sectional view of a borehole which has been formed in accordance with the present invention.
Figure 7:
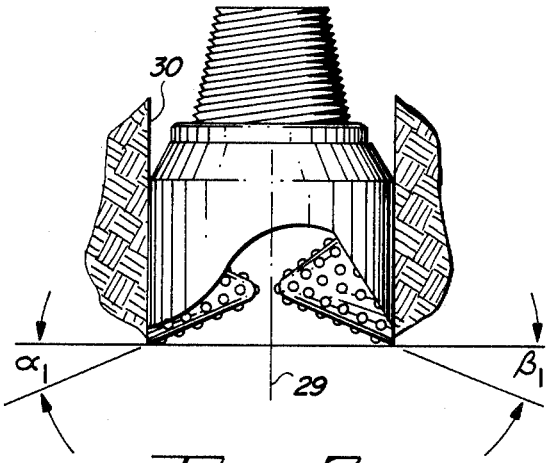
FIG. 7 (PRIOR ART)
FIG. 7 is a side elevational view of a prior art drill bit.
Figure 8:
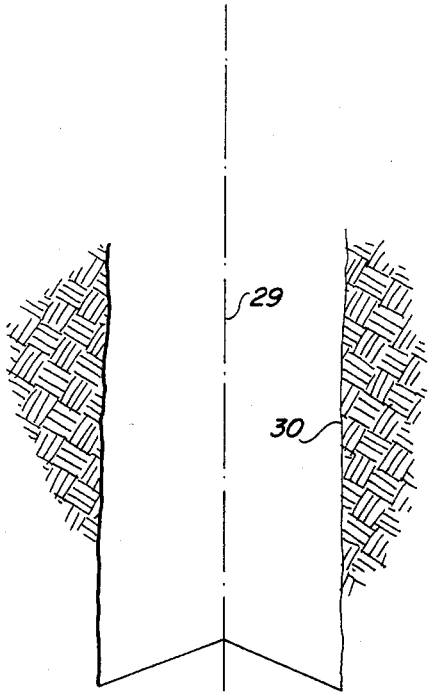
FIG. 8 (PRIOR ART)
FIG. 8 is a part diagrammatical, part schematical, part cross-sectional view of a borehole which has been formed with the prior art bit of FIG. 7.

Numeral 29 indicates the axial centerline of the shank which coincides with the axial centerline 29 (FIG. 6) of the borehole 30. Numeral 31 indicates the portion of the formation removed by cone 14, while numeral 32 indicates the portion of the formation removed by cones 13 and 15.

FIG. 4 is a hypothetical view of cone 14 as though the surface of the cone were unrolled and laid out flat, rather than rolled up to form the cone. The placement of the teeth 17 on cone 14 is seen to be such that any circle drawn within the boundaries of the cone and having the point 33 as its center will intersect two or more teeth 17.

The cutting surface of the cones is arranged such that the centroid of the plurality of cones lies on the obliqued centerline respective to the longitudinal axis of the shank.

The longitudinal axial centerline of the shank and pin coincides with the centerline of the borehole in a manner which causes the lowermost surface of one cone to penetrate in advance of the other cones, with the lowermost cone removing material from an inner conical part of the bottom of the borehole while the other cones remove an upper annular area from the bottom of the borehole, so that the resultant bottom of the borehole, when viewed in cross-section, reveals a step wherein the outer annular area is located slightly above the inner circular area. The slope of the conical surface depends upon the configuration of the cones and the angle $\beta_2$.

Moreover, the drill bit of this invention provides a means by which a greater penetration rate of the borehole can be achieved at lower cost. This unexpected advantage of the present invention is believed to result from the relative position of the cutting elements respective to the shank and borehole, wherein the angle measured between the axis of rotation of one cutting element or cone with respect to a plane extending perpendicular to the centerline of the borehole is less than the angle formed between the centerline of rotation of the remaining cutter elements or cones.

Furthermore, the arrangement of the nozzles between the cones provides a unique flow path for the drilling fluid. During rotation of the bit, the path described upon the bottom face of the borehole by the drilling fluid leaving one nozzle is a circle having a center which coincides with the axis of the borehole, while the drilling fluid leaving the remaining nozzles describes a path upon the bottom face of the borehole which is a circle having its center coinciding with the centerline of the borehole in a radius that is different from the radius of the circle described by the fluid leaving the first nozzle.

The three coned zero deviation bit of this invention differs from the prior art three coned drill bits namely in that the centerline through the cutterhead of the bit below the tool joint is formed at an angle of $\theta$ degrees with respect to the centerline of the bit in the area of the tool joint, or shank. Because of this angle $\theta$, the bottom extension of the legs of the cutterhead have been offset from the centerline of the borehole. This offset causes a weight applied from above the bit to be transferred unevenly to the three cones, and because it is applied at an angle, $\theta$, there will be a relatively small radial force effected on each of the cones. This resultant radial force effected on the cones will always act in the same relative direction respective to the drill tool, and therefore, directed towards a particular or specific area associated with the outside edge of the bit. Although this radial force may increase or decrease, respectively, as the weight on the bit increases or decreases, respectively, it will always force the recited specific part of the bit to the outside of the hole as the bit rotates through 360° of rotation, as noted in FIG. 2 at 21.

Current prior art practice is to use stabilizers placed in the drill string at such locations that tend to make the bit stiff so that it will not bend or move to the side when an opposing force ($F_F$) from the formation being drilled is encountered, such as an inclined formation. On the other hand, the bit is sometimes made very limber in order to take advantage of the centrifugal forces associated with the bit due to the bit rotation. Once the driller the hole is deviating for "a force ($F_F$) is deviating the hole"; bit (WOB) and the rotary speed (RPM) can be adjusted to oppose and overcome the deviating force. However, by this time the hole could very easily be deviated several degrees before these remedies are used. Another disadvantage to these somewhat successful techniques is that the optimum values of WOB, RPM, and pump pressure required to drill a minimum cost hole will have been changed to the values required to drill a minimum deviated hole. This slows down the penetration rate (ROP), thereby increasing the cost of drilling the well.

The three coned zero deviation bit of the present invention uses a prior art cutterhead from a three coned rock bit which is arranged so that the cone area of the bit is offset from the centerline of the drill string by an angle $\theta$. This oblique angle between the cone area and the drill string causes one particular side (numeral 21, FIG. 2) of the bit to be constantly pushing against the side of the hole whenever there is any drill string weight acting on the bit, thus attempting to cause the bit to deviate towards the outside of the hole with an inherent radial force ($R_T$). But because this rotating radial force pushes the bit in all radial directions as the bit rotates through 360° of rotation, the hole will not deviate from its original angle with respect to the vertical direction. Because of the radial force ($R_T$) which is inherent in the bit, any opposed force ($F_F$) effected by the formation will be vectorally added to the bit radial force. Consequently, the resultant deviating force ($R_D$) will change direction as the bit rotates. As long as the angle $\gamma$ through which ($R_D$) acts is small, the bit will be forced to the outside of the hole. Inasmuch as the radial force of the bit ($R_T$) is constantly opposing a force ($F_F$), even when ($F_F$) equals zero, ($F_F$) is never allowed to increase to its maximum possible value realized with the current prior art three coned bit.

FIG. 1 together with Table 1 indicates the specifications of the three coned zero deviation bit which differ from the prior art three coned bits. One major difference noted is the angle $\theta$, which is the angle between the centerline of the tool joint and the centerline of the cutterhead of the bit. The size of a three coned zero deviation bit of this invention can be selected by using the specifications of a smaller size prior art three coned bit.

For example, an 8½ inch three coned zero deviation bit will have all the exact same specifications of a 7⅞ inch prior art bit, but would be modified by arranging the cutterhead and shank as noted by $\theta$ and $\Delta h$. The increased height of the leg of the bit that supports cone 14 is $\Delta h$. By increasing the height of one leg of the bit, the angle $\theta$ is formed. Angle $\theta$ is a critical angle for any given zero deviation bit size that uses the specifications of the corresponding prior art bit size of the table. Each zero deviation bit size will have the same IADC code as that of the prior art three coned bit size from which it receives its specification. Table #1 indicates the bit sizes and their specifications.

The zero deviation bit continuously opposes hole deviation while drilling with a maximum penetration rate. A suitable stabilizer means, preferably a six point bottom hole reamer, must be placed immediately above the bit in order for these theories and formulas to be reliable. Because the (WOB) is acting at a slight angle $\theta$, with respect to the center of the cones, the bit will have a residual radial force, ($R_T$), trying to push the bit to a point diametrically opposite the center of the lowermost cone. This force rotates with the bit during bit rotation, thereby constantly urging the same point of the bit towards the outside wall of the hole. ($R_T$) is increased or decreased as (WOB) and (RPM) is increased or decreased, respectively.

When force ($F_F$) is applied to the bit and thereby induces hole deviation, it is vectorally added to ($R_T$). As seen in FIG. 2, this causes the direction of ($R_D$) to vary from $-\gamma$ to $+\gamma$ degrees from its original undisturbed direction. The value of $\gamma$ may be kept to a minimum by minimizing ($F_F$) or maximizing ($R_T$). As long as the angle $\gamma$ is less than 60°, the direction of ($R_D$) will force the bit to the outside of the hole and no deviation will occur. The following example illustrates the typical calculations and compares the prior art three coned bit forces with those of the novel zero deviation bit of this invention.

EXAMPLE #1

Drill an 8½ inch hole with 40000# WOB, 50 RPM, $F_F$=1000#, ROP=15 ft/hr.

With the prior art three coned bit:

up to 1000 feet of hole may inadvertently be drilled before the deviation is discovered. At that time, the RPM may be increased to 55 to 60 RPM and the WOB would be decreased to 15,000# to 20,000#. If the hole does not straighten up, the bit may have to be pulled, the bottomhole assembly changed, and drilling resumed with a further reduced WOB and increased RPM. The ROP will probably have decreased from 15 ft/hr. to less than 5 ft/hr. Hence, it can be appreciated that with a prior art bit, correcting a deviated hole is more of an art than a science. In the above hypothetical situation, when the hole angle $\phi$ is zero, the centrifugal force on the bit due to the rotary speed is zero. As $\phi$ increases, $\rho$ will increase and the centrifugal force $F_C$ will increase as defined by the following equation:

$$F_C = m/32.2 \times (RPM/30 \times RPM/30 \times \rho),\ R_T = F_C$$

$\theta=0$, $\gamma$ is undefined, $CW_1=CW_2=CW_3=\frac{1}{3}\times WOB$

With the three coned zero deviation bit:

$$CW_1=(0.375D+\Delta x)\times WOB)\div 0.75D=21960\#$$

$$CW_2=CW_3=((0.375D-\Delta x)\times WOB)\div 1.5D=9020\#$$

$$R_T=(R_1+R_2+R_3)+(F_{c1}+F_{c2}+F_{c3})$$

$$R_1=CW_1\times \sin\theta$$

$$R_2=R_3=\tfrac{1}{2}CW_x\times \sin\theta$$

$$m_{c1}=m_{c2}=m_{c3}=5\#\theta=2.045°$$

$$F_{c1}=(0.1m_{c1}/32.2)\times(RPM/30)^2\times\Delta x)-(0.9m_{c1}/32.2)\times(RPM/30)^2\times\rho_1)$$

$$\rho_1=r_B-\Delta x$$

$$F_{c2}=\tfrac{1}{2}m_{c2}/32.2\times(RPM/30)^2\times\rho_2$$

$$F_{c3}=\tfrac{1}{2}m_{c3}/32.2\times(RPM/30)^2\times\rho_3$$

$$\rho_2=\rho_3=r_B+\Delta x \sin 60°$$

$$R_T = (21960 \times \sin 2.045°) + (\tfrac{1}{2} \times 9020 \times \sin 2.045°) + (\tfrac{1}{2} \times 9020 \times \sin 2.045°) + ((0.1 \times 5/32.2 \times (50/30)^2 \times .875) - (0.9 \times 5/32.2 \times (50/30)^2 \times (8.5/2 - 0.875))) + (\tfrac{1}{2} \times 5/32.2 \times (50/30)^2 \times (8.5/2 + 0.875 \sin 60°)) + (\tfrac{1}{2} \times 5/32.2 \times (50/30)^2 \times (8.5/2 + 0.875 \sin 60°)).$$

$$R_T=1106.596\#$$

$$\gamma=\tan^{-1}(F_F/R_T)=\tan^{-1}(1000/1106.596)=42.1°$$

Accordingly, the novel zero deviation bit of this invention will drill a hole that will not deviate from the angle at which it first starts drilling. In the instance where the bit starts drilling in a hole which is at an angle of zero degrees deviation to vertical, then it will continue to drill the hole at that angle. On the other hand, should the bit be used for drilling a hole already deviated at an angle of 30° to vertical, it will continue to drill at an angle of 30°. This is because the bit will not deviate from the desired direction, and therefore, optimum values of WOB, RPM, and pump pressures necessary to drill a minimum cost hole may be used, all of which results in a high rate of penetration and less problems in a highly deviated formation, that is, formations known to cause unacceptable deviations of a borehole.

The term "stabilizer" used herein is intended to define and describe an apparatus which engages the borehole wall and provides a force equal and opposite to the force 21 of FIG. 2, as the bit rotates. This can be achieved by the provision of a reamer having non-cutting rollers for engagement with the borehole wall.

It is not necessary that the rollers be equally spaced circumferentially about the shank, but it is desirable that two adjacent rollers be used on the side of the shank in the area of 21 and to be spaced sufficiently apart to oppose force 21 which varies from $-\gamma$ to $+\gamma$. But as a matter of practicallity, the employment of three rollers in a group, with two of the rollers being placed on opposed sides of $-\gamma$ and $+\gamma$ at 21, is preferred.

TABLE #1

| Bit Specifications vs Prior Art | | | |
|---|---|---|---|
| Diameter of The Invented Bit | Dia. Of The Prior Art Bit | $\theta$ (degrees) | $\Delta$h (inches) |
| 7⅞" | 6¾" | 4.038° | 0.344" |
| 8½" | 7⅞" | 2.045° | 0.205" |
| 8¾" | 7⅞" | 2.862° | 0.286" |
| 12¼" | 11" | 3.261° | 0.442" |
| 14¾" | 12¼" | 5.978° | 0.812" |
| 15" | 12¼" | 6.096° | 0.828" |

The main difference between a zero deviation bit of Table 1 and a current prior art bit of Table 1 is the specifications $\theta$, and $\Delta$h as noted in the above table. IADC codes do not change.

Definition of Terms and Abbreviations as used in this disclosure:

$\phi$—angle of hole deviation from vertical $\theta$—angle of bit from drill string centerline $\alpha_1$—angle of cone #2 or #3 face with respect to horizontal on prior art bits $\alpha_2$—angle of cone #2 or #3 face with respect to horizontal on the zero deviation bit $\beta_1$—angle of cone #1 face with respect to horizonatal on prior art bits $\beta_2$—angle of cone #1 face with respect to horizontal on the zero deviation bits $\gamma$—angle between $R_D$ and $R_T$ $F_F$—a force acting against one side of the bit and attempting to push the bit to the other side of the hole WOB—weight applied to a bit to cause the bit to drill RPM—rotary speed to the bit in revolutions per minute ROP—rate of penetration of the bit in feet per hour $R_D$—radial force resulting from the vectoral addition of $R_T$ and $F_F$ $R_T$—total residual radial force on the bit due to $F_c$ and WOB $F_c$—centrifugal force acting on the bit m—mass of the bit in pounds $\rho$—distance from axis of rotation to outer edge of rotating object $\Delta$x—one half of the difference between the diameters of the present invention bit and the prior art bit as used in accompanying Table #1

$\Delta$h—a specification of the zero deviation bit

D—diameter of the present invention bit

CW—proportionate weight on indicated cone #1, #2, or #3

$r_B$—radius of the present invention bit

The following equations are used in the foregoing determinations:

$$F_c = m/32.2 \times (RPM/30 \times RPM/30 \times \rho)$$

$$F_{c1} = (0.1m_1/32.2 \times RPM/30 \times RPM/30 \times \Delta x) - (0.9\text{-}m_1/32.2 \times (RPM/30 \times RPM/30 \times \rho_1)$$

$$F_{c2} = \tfrac{1}{2} \times m_2/32.2 \times RPM/30 \times RPM/30 \times \rho_2$$

$$F_{c3} = \tfrac{1}{2} \times m_3/32.2 \times RPM/30 \times RPM/30 \times \rho_3$$

$$CW_1 = (0.375D + \Delta x) \times WOB \div 0.75D$$

$$CW_2 = CW_3 = (0.375D - \Delta x) \times WOB \div 1.5D$$

$$R_T = (R_1 + R_2 + R_3) + (F_{c1} + F_{c2} + F_{c3})$$

$$R_1 = CW_1 \sin\theta$$

$$R_2 = \tfrac{1}{2} \times CW_2 \sin\theta$$

$$R_3 = \tfrac{1}{2} \times CW_3 \sin\theta$$

$$R_D = R_T + F_F$$

$$\gamma = \tan^{-1}(F_F/R_T)$$

I claim:

1. A rotary drill bit for forming a borehole, comprising a shank having a pin at the upper end thereof and a cutterhead integrally formed at the lower end thereof; said cutterhead includes cutting elements formed thereon, said cutterhead being arranged such that the centerline of the cutterhead is inclined at an angle with respect to the centerline of the shank, and stabilizer means attached to said shank for urging the centerline of the shank to coincide with the centerline of the borehole.

2. The bit of claim 1 wherein said shank includes an axial passageway extending therethrough, said cutterhead includes flow nozzles positioned between adjacent cones by which drilling fluid can be directed towards the cones and towards a formation being drilled;

and means forming passageways by which said nozzles are connected to receive flow from said axial passageway.

3. The bit of claim 2 wherein said cutterhead includes three cones journaled thereto, the lowermost surface of the lowermost cone lies at a first acute angle respective to a plane arranged perpendicularly respective to the axial centerline of the shank;

the other cones have a lowermost surface which lie at a second acute angle respective to the recited plane, said first acute angle being larger than said second acute angle.

4. The bit of claim 3 wherein said stabilizer means includes a plurality of rollers circumferentially spaced about said shank and rotatably attached in parallel relationship thereto for causing the drill bit shank to be urged into axially aligned relationship with respect to the borehole during a drilling operation.

5. In a rotary drill bit having a shank, a pin formed at the upper end of said shank, and a cutterhead formed at the lower end of said shank; the improvement comprising:

said cutterhead supports a plurality of cutting elements thereon; said cutting elements having means forming cutting teeth thereon; said cutterhead being obliquely and integrally affixed to said shank such that the axial centerline of the cutterhead is inclined at an angle with respect to the axial centerline of the shank, with the angle formed between the centerline of rotation of one cutting element with respect to a plane perpendicular to the centerline of the borehole is greater than the angle between the centerline of rotation of all the remaining cutting elements with respect to a plane perpendicular to the centerline of the borehole;

whereby, one cutting element will always be located at a lower elevation with respect to the other cutting elements.

6. The rotary drilling bit of claim 5 wherein a drilling fluid passageway is formed along the longitudinal axial centerline of said shank; means forming nozzles between adjacent cutting elements; means forming a passageway from said axial passageway to each said nozzle such that while the bit is being rotated the path inscribed upon the bottom face of a borehole by the drilling fluid leaving one nozzle describes a circle whose center is on the centerline of the borehole, while the drilling fluid leaving all the remaining nozzles while the drill bit is being rotated track a path upon the bottom face of the borehole described as a circle with its center on the centerline of the borehole and a radius that is a different length than the radius of the circle described by the fluid leaving the first nozzle.

7. The drill bit of claim 6 wherein said cutting teeth of the cutting elements are arranged such that any circle inscribed upon the outer surface of a cutting element and having its center fall anywhere along the length of the centerline of the axis of rotation of the cutting element will intersect with a plurality of cutting teeth.

8. The bit of claim 7 wherein said shank includes a plurality of rollers circumferentially spaced thereabout and attached thereto for causing the drill bit shank to remain axially aligned with the borehole during a drilling operation.

9. The bit of claim 8 wherein said cutterhead includes three cones journaled thereto, the lowermost surface of the lowermost cone lies at a first acute angle respective to a plane arranged perpendicularly respective to the axial centerline of the shank; the other cones have a lowermost surface which lie at a second acute angle respective to the recited plane, said first acute angle being larger than said second acute angle.

10. In a borehole forming operation wherein a drill string rotates a drill bit for penetrating a geological formation, the drill bit having a main body in the form of a shank for attachment to a drill string and a cutterhead integrally attached to the shank, at least three cones are rotatably affixed to the cutterhead, the method of forming a straight borehole, comprising the steps of:

(1) positioning one of said cones at a lower elevation respective to the other of said cones by positioning all of the cones in a plane such that a portion of each of the cones is intersected by the plane which is arranged perpendicularly respective to the centerline of the cutterhead and obliquely respective to the central axis of the shank of the main body;

(2) rotating the bit while forcing the bit to penetrate the formation and thereby form the borehole;

(3) whereby the lowermost cone forms a conical area centrally of the bottom of the borehole while the other cones form an annular area slightly above the conical area.

11. The method of claim 10 and further including the steps of:

urging the shank to remain centrally aligned along the central axis of the borehole by placing a plurality of stabilizers about the main body at a location immediately above the cutterhead of the bit.

12. The method of claim 10 and further including the steps of forcing drilling fluid through said main body and through nozzles located between adjacent cones.

13. The method of claim 10 and further including the steps of attaching the cones to the cutterhead and attaching the cutterhead to the shank in a manner whereby the rotational axis of each cone lies along a plane which lies at an acute angle respective to a plane arranged normal to the longitudinal central axis of the shank.

14. A rotary drill bit for drilling a borehole, comprising a shank having a threaded connection at the upper end thereof and a cutterhead integrally formed at the lower end thereof; said cutterhead includes cutting elements, means rotatably mounting the cutting elements to the cutterhead; said cutterhead being arranged such that the centerline of the cutterhead is inclined at an angle with respect to the centerline of the shank, and stabilizer means attached to said shank for urging the centerline of the shank to coincide with the centerline of the borehole;

whereby, one cone can always be located at a lower elevation respective to the other cones.

* * * * *

UNITED STATES PATENT AND TRADEMARK OFFICE

CERTIFICATE OF CORRECTION

PATENT NO. : 4,580,642

DATED : APRIL 8, 1986

INVENTOR(S) : MARK A. GOSCH

It is certified that error appears in the above-identified patent and that said Letters Patent is hereby corrected as shown below:

Column 2, line 17, delete "three a" and insert -- a three --.

Column 4, line 59, insert --realizes that-- after "driller";

Line 60, delete "for "a force ($F_f$) is deviating the";

Line 61, delete "hole";" and insert --the weight on the-- before "bit";

Column 6, line 34, delete "three coned";

Line 44, substitute --2-- for "x" after "CW";

Line 46, substitute --5# θ-- for "5#θ".

Signed and Sealed this

*Twenty-second* Day of *July 1986*

[SEAL]

*Attest:*

DONALD J. QUIGG

*Attesting Officer* *Commissioner of Patents and Trademarks*